US011183799B2

(12) United States Patent
Kimmet

(10) Patent No.: US 11,183,799 B2
(45) Date of Patent: Nov. 23, 2021

(54) ELECTRICAL POWER INLET CONNECTION DEVICE AND METHOD

(71) Applicant: Stephen G. Kimmet, Tiffin, OH (US)

(72) Inventor: Stephen G. Kimmet, Tiffin, OH (US)

( * ) Notice: Subject to any disclaimer, the term of this patent is extended or adjusted under 35 U.S.C. 154(b) by 0 days.

(21) Appl. No.: 16/839,432

(22) Filed: Apr. 3, 2020

(65) Prior Publication Data

US 2020/0321737 A1 Oct. 8, 2020

Related U.S. Application Data

(60) Provisional application No. 62/829,671, filed on Apr. 5, 2019.

(51) Int. Cl.

| | |
|---|---|
| ***H01R 13/713*** | (2006.01) |
| ***H01R 13/655*** | (2006.01) |
| ***H01R 24/78*** | (2011.01) |
| ***H01R 25/00*** | (2006.01) |

(52) U.S. Cl.

CPC ..... *H01R 13/7135* (2013.01); *H01R 13/655* (2013.01); *H01R 24/78* (2013.01); *H01R 25/006* (2013.01)

(58) Field of Classification Search

CPC ..... H01R 31/06; H01R 31/02; H01R 25/003; H01R 25/006; H01R 13/7135; H01R 13/655; H01R 24/78

USPC ..... 439/502, 652, 651

See application file for complete search history.

(56) References Cited

U.S. PATENT DOCUMENTS

| | | | | |
|---|---|---|---|---|
| 4,659,161 | A * | 4/1987 | Holcomb | H01R 31/02 439/490 |
| 9,190,785 | B1 * | 11/2015 | Rogero | H01R 35/04 |
| 2012/0261988 | A1 * | 10/2012 | Byrne | H02J 3/00 307/35 |
| 2012/0292991 | A1 * | 11/2012 | Dodal | H02H 3/16 307/11 |
| 2014/0369977 | A1 * | 12/2014 | Zhang | A61P 35/00 424/93.21 |
| 2015/0001937 | A1 * | 1/2015 | Wang | G06F 1/16 307/52 |
| 2015/0214708 | A1 * | 7/2015 | Segnit | H02G 3/081 361/42 |
| 2016/0064883 | A1 * | 3/2016 | Macauda | H01R 25/003 439/40 |
| 2016/0105021 | A1 * | 4/2016 | Murray | G02B 6/4278 385/75 |

(Continued)

*Primary Examiner* — Gary F Paumen

(74) *Attorney, Agent, or Firm* — Jacob M. Ward; Ward Law Office LLC

(57) ABSTRACT

An electrical power inlet connection device, can be attached to portable and/or transitional physical structures. While interacting with tools, an individual may utilize electrical and electronic devices to work on material, where the electrical power inlet connection device can be attached on an inside of, for example, a sawhorse leg. The electrical power inlet connection device has at least one female power outlet and a ground fault circuit interrupter (GFCI) compartment, like those currently utilized near sinks for safety. However, the electrical power inlet connection device can only have a single male power plug. With GFCI, all electrical power inlet connection device applications assure added electrical security. A USB or other electrical/electronic connections can be added to the compartment for connecting to music sources, cell phones, the Internet, etc. within a GFCI compartment.

20 Claims, 4 Drawing Sheets

(56) References Cited

U.S. PATENT DOCUMENTS

| | | | | |
|---|---|---|---|---|
| 2016/0191268 | A1* | 6/2016 | Diebel | H04L 67/12 709/223 |
| 2016/0254628 | A1* | 9/2016 | Liao | H01R 24/76 439/535 |
| 2016/0329673 | A1* | 11/2016 | McCormick | G05F 3/02 |
| 2017/0063008 | A1* | 3/2017 | Goyal | H01R 13/6675 |
| 2017/0141505 | A1* | 5/2017 | Forti | H02G 3/18 |
| 2018/0297038 | A1* | 10/2018 | Costello | B02C 18/0007 |
| 2018/0316201 | A1* | 11/2018 | Miller | H01R 27/02 |
| 2018/0360197 | A1* | 12/2018 | Weaver | A45D 44/02 |
| 2018/0366928 | A1* | 12/2018 | Dumani | H02G 3/081 |

* cited by examiner

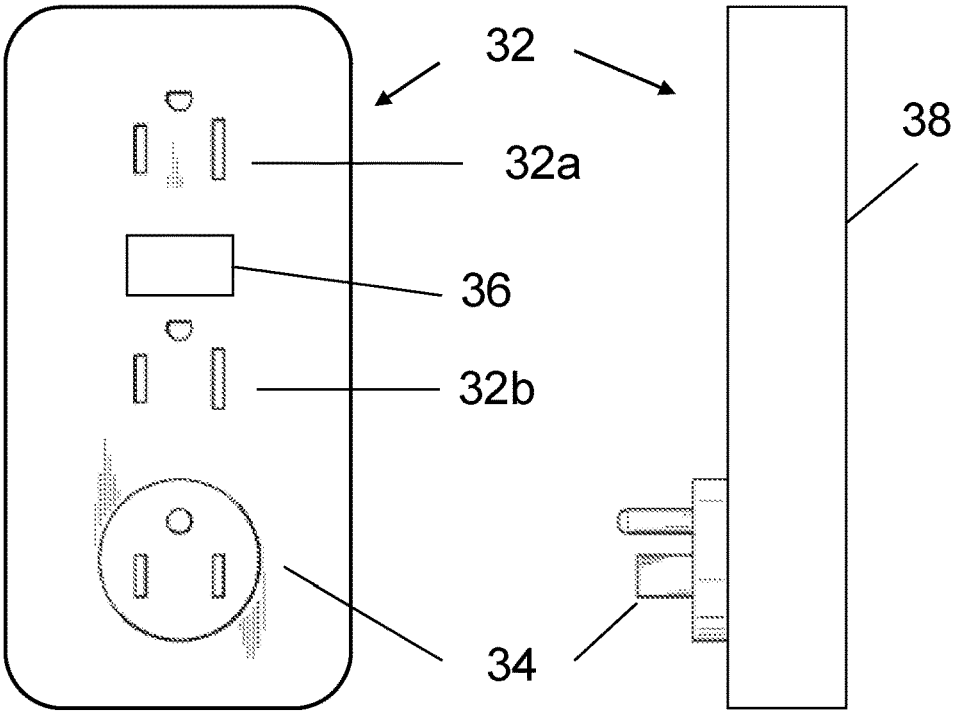
FIG. 3
FIG. 4
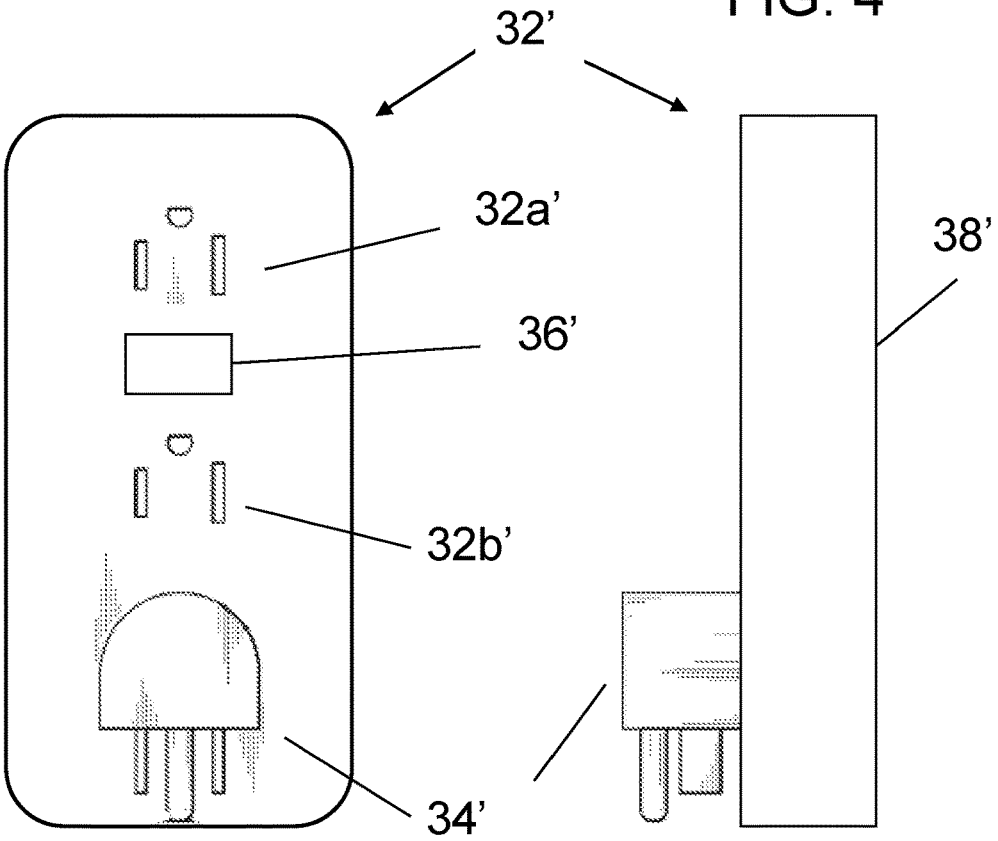
FIG. 5
FIG. 6

ELECTRICAL POWER INLET CONNECTION DEVICE AND METHOD

CROSS-REFERENCE OF RELATED APPLICATION

This Application claims benefit of U.S. Provisional Patent Application Ser. No. 62/829,671, filed Apr. 5, 2019. The entire disclosure of the above application is hereby incorporated herein by reference.

FIELD

The present disclosure generally relates to an electrical power inlet connection device and method.

BACKGROUND

There are many portable and/or transitional physical structures, like sawhorses, tables, straight chairs, lounge chairs, golf carts, automobiles, trucks, and building additions, to name a few. These portable and/or transitional physical structures require interaction with electrical equipment and devices. Examples of such electrical equipment and devices are power tools, lighting, battery charging stations, electronics, machines, internet connecting devices, appliances, vacuums, sound equipment, smart devices, vehicles, and outdoor maintenance equipment.

Typically, electrical power is supplied to electrical equipment and devices, associated with the portable and/or transitional physical structures, by way of extension cords. Unfortunately, the extension cords are cumbersome to handle and may be exposed to liquids and other conditions that can pose unsafe electrical and fire conditions, which can cause harm to humans, animals and physical items. Prior art FIG. 1 illustrates such a typical cumbersome and unsafe arrangement.

What is needed is a less cumbersome and a safer way to supply electrical power to the various electrical equipment and electronic devices that interact with the portable and/or transitional physical structures.

SUMMARY

In accordance with the instant disclosure, an electrical power inlet connection device may be attached to stationary, portable and/or transitional physical structures. There are many forms and sizes of portable and transitional physical structures. For example, a sawhorse is utilized by a craftsman or handyman while utilizing electrical and electronic devices that electrically connect to established electrical power sources that supply power to tools, for example, saws, drills, and grinders, in order to work on materials.

For the sawhorse example, as shown in FIG. 2, an electrical power inlet connection device can be mounted on an inside of a leg of the sawhorse, but other locations on the sawhorse are possible. The electrical power inlet connection device has at least one female power outlet and a ground fault circuit interrupter (GFCI) compartment (which may include a USB connection for connecting to music sources, cell phones, the Internet, etc.), like those utilized near sinks and pools for safety. Further, the electrical power inlet connection device has a single male power inlet (i.e. a plug), whose physical orientation to a case of the electrical power inlet connection device can be parallel, perpendicular, and even pivotable, see FIGS. 3-6.

A single electrical power inlet connection device can have more than one female power outlet receptacle on it. However, the single electrical power inlet connection cannot have more than one male power inlet on it, so as to avoid allowing a mix of two or more separate electrical power sources. By having multiple electrical power inlet connection devices on the same or other portable and/or transitional physical structures, the single male power inlet allows multiple portable and/or transitional physical structures to be electrically daisy chained together, see FIG. 7.

The instant electrical power inlet connection device can be attached to any structure, like a common stake, a post, a pole, or permanent column in the ground or attached to a building, but especially attached to a portable structure, like tables, straight chairs, lounge chairs, vehicles, etc. In fact, the electrical power inlet connection device can even be attached to any transitional structure, like a building structure that is being built or remodeled where power outlets are not yet fully established. Also, electrical power inlet connection devices can be periodically attached to structures and then removed, for example musical and sports gathering events indoor or outdoor that come and go throughout a year.

A USB or other connection devices can be added to the electrical power inlet connection devices for connecting to music sources, cell p, the Internet, etc. within a GFCI compartment. Specifically regarding GFCI, all electrical power inlet connection device applications are thereby assured of added electrical and fire security! With extra female power outlet receptacles on the electrical power inlet connection device, multiple devices, like alarm devices, can be plugged therein to enhance security of a facility.

BRIEF DESCRIPTION OF THE DRAWINGS

FIG. 3 illustrates a front elevational view of a first embodiment of the electrical power inlet connection device of the present invention;

FIG. 4 illustrates a right side elevational view of the first embodiment of the electrical power inlet connection device shown in FIG. 3;

FIG. 5 illustrates a front elevational view of a second embodiment of the electrical power inlet connection device of the present invention;

FIG. 6 illustrates a right side elevational view of the second embodiment of the electrical power inlet connection device shown in FIG. 5;

DESCRIPTION

Figure 1:
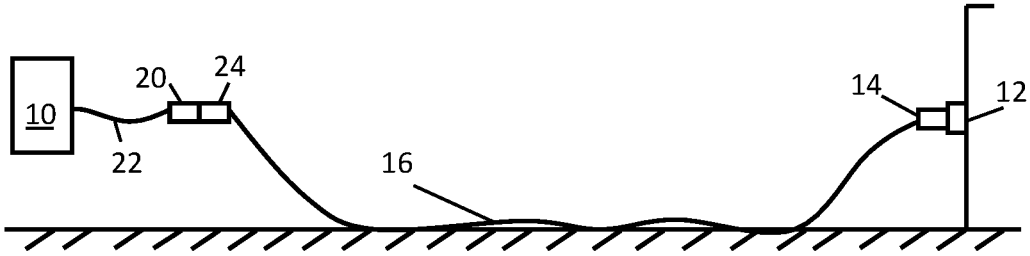
FIG. 1 PRIOR ART
FIG. 1 illustrates a prior art schematic of a tool being directly electrically connected to an established electrical power source, by way of a conventional extension cord.

The following description is merely exemplary in nature and is not intended to limit the present disclosure, application, or uses. It should also be understood that throughout the drawings, corresponding reference numerals indicate like or corresponding parts and features. In respect of the methods disclosed, the order of the steps presented is exemplary in nature, and thus, is not necessary or critical.

Currently, as illustrated in prior art FIG. 1, in order to supply electrical power to a tool 10, let it be understood that the designation "10" can apply to any device that is powered, for example, lights and an infinite number of items in place of the tool. Because the tool may be located far from an established power female connector 12, an individual might start by connecting a male connector 14, on an extension cord 16, to the established power female connector 12. Then, at the far other end of the extension cord 16, the individual would connect a female connector 24 of the extension cord 16 to a male plug 20 on the end of a power cord 22 attached to the tool 10. Thereby, the distant tool 10 would be electrically connected to the established electrical power source, not shown but unknown in the art.

Figure 2:
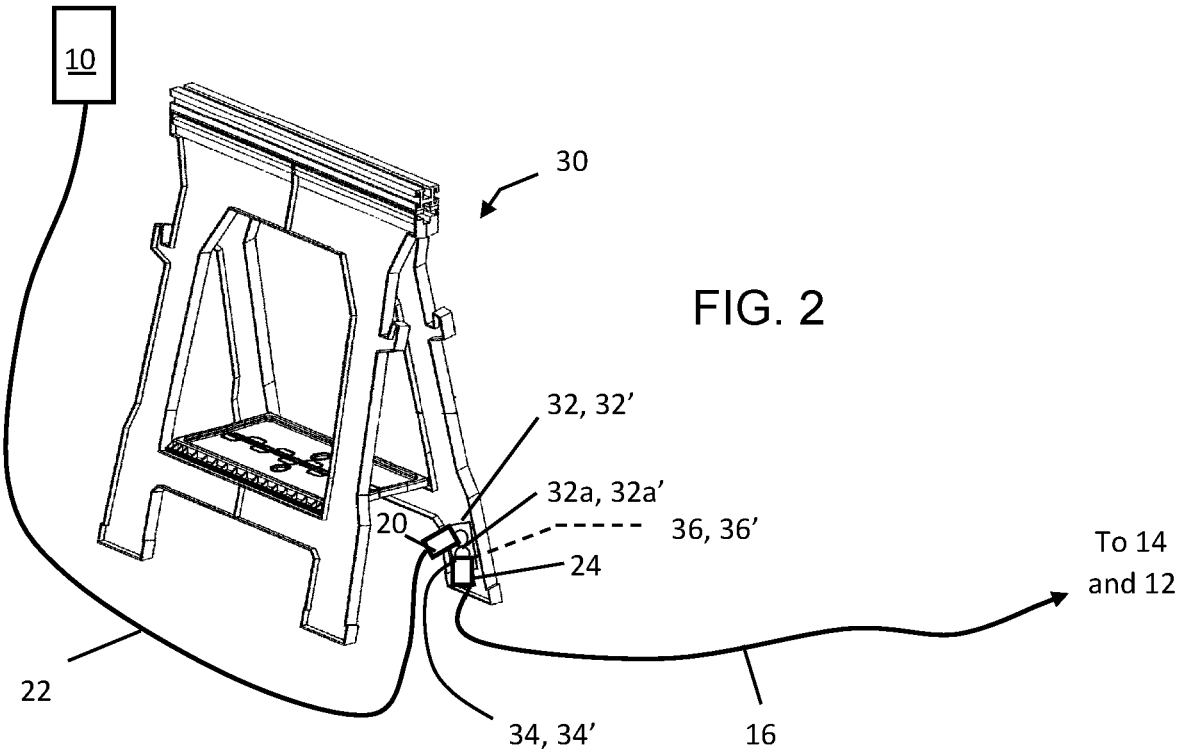
FIG. 2 illustrates a perspective view of a sawhorse having an electrical power inlet connection device of the present invention disposed thereon, the tool shown in FIG. 1 being electrically connected to the electrical power inlet connection device, the extension cord of FIG. 1 being electrically connected on a first end to the electrical power inlet connection device and on a second end being connected to the established electrical power source of FIG. 1.

Although not shown, the individual may even add an additional extension cord between the first extension cord 16 and the established power female connector 12! In either case, it can be seen that the likely prior art connection scenarios are cumbersome because the individual would need to repeatably "swing" a significant portion of the connected extension cord(s) 16 and the connected tool power cord 22. This would be required because the individual is likely to constantly make adjustments to his/her position, while making the necessary operations on the part. Likely adjustments to the process being performed by the individual would be drilling and grinding, or adjusting materials that are being worked out upon the sawhorse. Unfortunately, but commonly, the individual may be exposed to electrical shock conditions or fire hazards if the extension cord(s) 16 becomes frayed or is cut, and especially if exposed to moisture, fire, chemicals, heat, and cold conditions In accordance with the present invention and as illustrated in FIG. 2, a sawhorse 30 (which could apply to any other portable and/or transitional physical structures, like building additions, tables, lounge chairs, straight chairs, golf carts, automobiles, and trucks, etc., as illustrated in FIGS. 8-14) has an inventive encased electrical power inlet connection device 32, 32' attached thereto, (as illustrated in FIGS. 3-6). Although there are many styles and forms that sawhorses can take, the present invention is not limited to the form of the sawhorse 30 that is shown in FIG. 2.

The craftsman or handyman utilizes electrical power tools 10, like saws, drills, and grinders, to work on the materials not shown but common in the art, like boards, in order to supply power to the tool 10 (i.e., electrical power equipment and devices). As such, the individual inserts the male connector 14 on the extension cord 16 into the female receptacle 12 of an established electrical power source, not seen but common in the art. Then, at the far other end of the extension cord 16, the individual would connect a female connector 24 of the extension cord 16 to a male plug 34, 34' of an electrical power inlet connection device 32, 32', which are respectively attached to the cases 38, 38' (see FIGS. 3-6). Finally, the male plug 20 of the tool 10 would be connected to a female receptacle 32*a*, 32*a*' or 32*b*, 32*b*' of the electrical power inlet connection device 32, 32'.

FIGS. 3-6 illustrate the details associated with the inventive electrical power inlet connection device 32, 32', which show two possible variations thereof. Specifically, the difference between these variations is the orientation of the male power inlets 34, 34', one being vertical and the other being horizontal to the plane of the front surface of its respective case 38, 38', both of which function the same. It should be understood, however that any orientation of the male power inlets 34, 34' is possible, even a swivel orientation would function the same.

Next, the male connector 20 on the end of the power cable 22, which is shown attached to the power tool 10, is plugged into one of the female power outlets 32*a*, 32*b*, or 32*a*', 32*b*' on the respective electrical power inlet connection device 32, 32'. Between the female power outlets 32*a*, 32*b* there is indicated ground fault circuit interrupters (GFCI), which are common in the art, that are separately located inside each of the GFCI compartments 36, 36' of the electrical power inlet connections 32, 32'.

It is to be noted that a single electrical power inlet connection device 32, 32' can have more than two added female power outlets 32*a*, 32*b*, or 32*a*', 32*b*'. However, an electrical power inlet connection device 32, 32' cannot have more than one male power inlet connector 34, 34' on it. The reason for this is to assure that there is not a mixing of two or more separate established power sources, like the established electrical power source that is connected to the connector 12, see FIG. 1.

Figure 7:
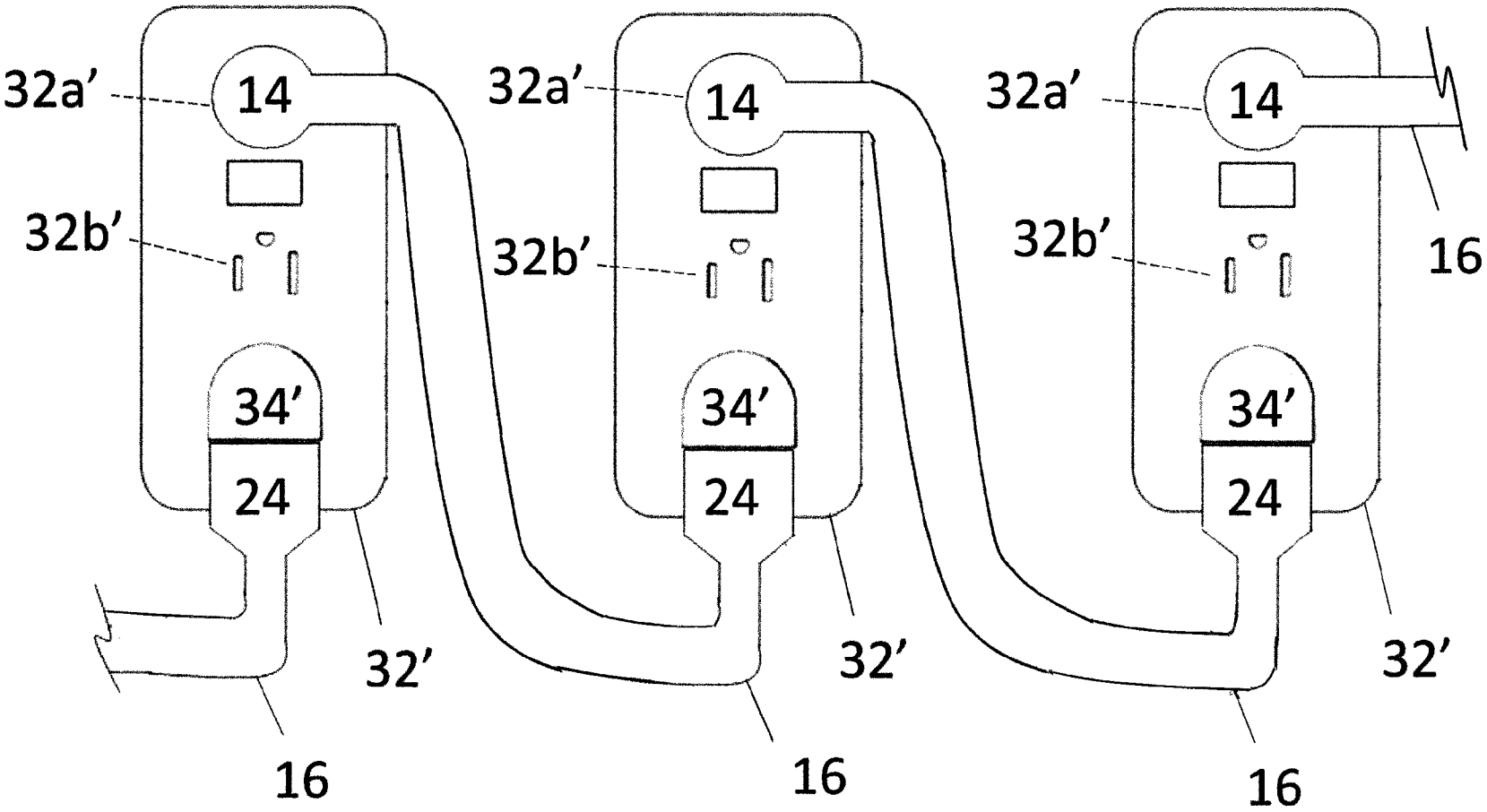
FIG. 7 illustrates three electrical power inlet connection devices in an electrical daisy chain arrangement.
Figure 8:
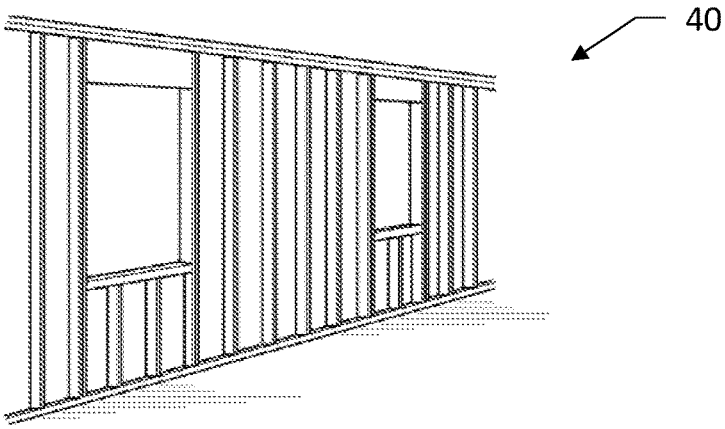
FIG. 8 illustrates an example of a transitional building structure in accordance with the present invention.
Figure 9:
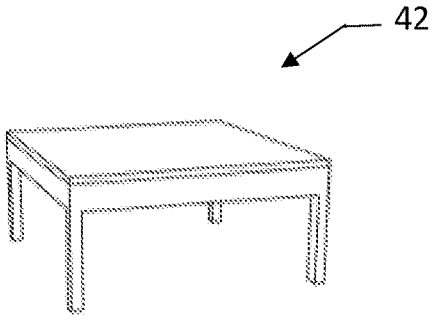
FIG. 9 illustrates an example of a table in accordance with the present invention.
Figure 10:
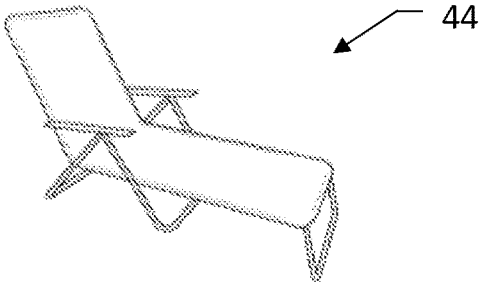
FIG. 10 illustrates an example of a lounge chair in accordance with the present invention.
Figure 11:
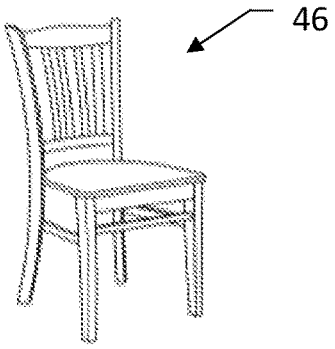
FIG. 11 illustrates an example of a straight chair in accordance with the present invention.
Figure 12:
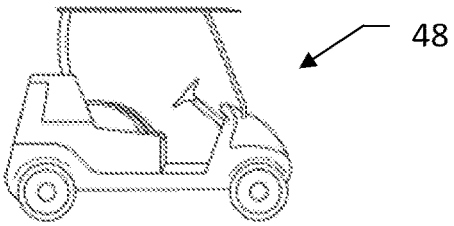
FIG. 12 illustrates an example of a golf cart in accordance with the present invention.
Figure 13:
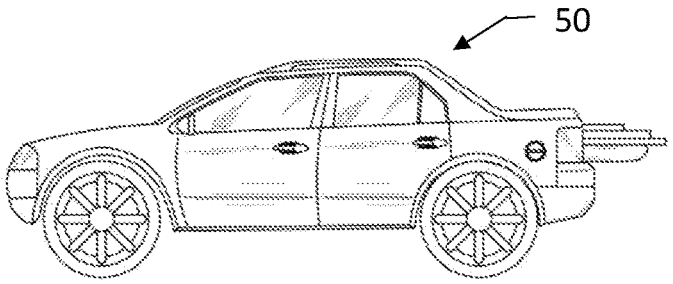
FIG. 13 illustrates an example of an automobile in accordance with the present invention.
Figure 14:
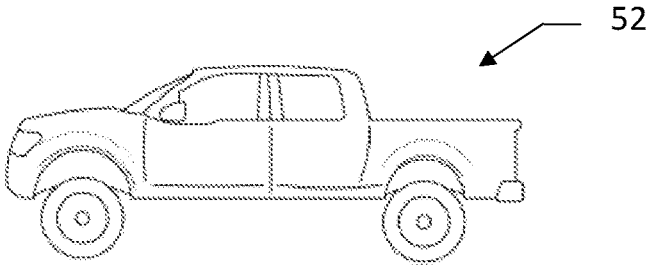
FIG. 14 illustrates an example of a truck in accordance with the present invention.

By way of applying multiple electrical power inlet connection devices 32 and 32', which can be mixed therebetween, on the same or different sawhorses 30 (or separate portable and transitional physical structures, like, tables 42, straight chairs 46, lounge chairs 44, golf carts 48, automobiles 50, trucks 52 (basically any vehicle), and building additions 40, etc.) there is provided a way to "daisy chain" multiple electrical power inlet connection devices 32, 32' together. This way to "daisy chain" is illustrated in FIG. 7, where multiple electrical power inlet connection devices 32, 32' can be electrically connected in series, along either of the connection paths 32*a*, 32*b*, or 32*a*', 32*b*' on respective electrical power inlet connection devices 32, 32'. Another example of items that can be plugged into the receptacle outlets 32*b*, 32*b*' are batteries that power hand held electric drills and saws, which can be charged along with a host of other devices that need no electrical cords.

FIG. 7 illustrates how the daisy chain process is established, while utilizing a series of electrical power inlet connection devices 32'. First, electrical power is supplied to a first extension cord 16 shown at the bottom left side of FIG. 7. Consequently, electricity is supplied to a male connector 24 of the first extension cord 16, which is plugged into a male inlet connector 34' on a first electrical power inlet connection device 32'. Hence, the female receptacles 32*a*', 32*b*' on the first electrical power inlet connection device 32' are internally electrically powered.

Continuing the daisy chain process, a male plug 14 on a second extension cord 16 is mated with the female receptacle 32*a*' on the first electrical power inlet connection device 32', while the male plug 34' of a second electrical power inlet connection device 32' is mated with the female receptacle 24 of the second extension cord 16. Hence, the female receptacles 32*a*', 32*b*' on the second electrical power inlet connection device 32' are then internally electrically powered.

Once again, continuing the daisy chain process, a male receptacle 14 on a third extension cord 16 is mated with a female inlet receptacle 32*a*' on the second electrical power inlet connection device 32', while the male plug 34' of a third electrical power inlet connection device 32' is mated with the female receptacle 24 of the third extension cord 16. This in turn internally electrically powers the female receptacles 32*a*', 32*b*' on the third electrical power inlet connection device 32'. Therefore, three electrical power inlet connection devices 32' are daisy chained together. Consequently, additional electrical power inlet connection devices 32' can be daisy chained together in a similar manner.

Thus, the daisy chain process allows multiple "unplugged" receptacle outlets 32*b*' on the three electrical power inlet connection devices 32' to be utilized for supplying electricity to an assortment of electrical power equipment and devices 10 and internally electrically connects GFCIs, USBs, etc. that may be connected internally within the three electrical power inlet connection devices 32'.

The instant electrical power inlet connection devices 32, 32' can be attached to any portable structure, e.g., sawhorses 30, tables 42, straight chairs 46, lounge chairs 44, vehicles 48, 50, 52, etc., as seen in FIGS. 2 and 8-14. In fact, the electrical power inlet connection devices 32, 32' can be attached to any structure, like a building structure 40 shown in FIG. 8 that is being built or remodeled where long term power outlets are not fully established or even will never have outlets established like barns and storage building. In addition, the instant electrical power inlet connection devices 32, 32' can be attached to individual posts, poles, concrete items in the ground, etc. The above mentioned USB and connectors or other connection devices can be added to the ground fault circuit interrupters (GFCI) compartments 36, 36' within electrical power inlet connection devices 32, 32' for charging devices, connecting to music sources, cell phones, the Internet, etc., not shown but common in the art.

One significant advantage that the electrical power inlet connection devices 32, 32' of FIGS. 2-6 provide over the prior art of FIG. 1, which connects directly to the tool 10 with the extension cord 16, is that an individual does not have to "swing" a cumbersome extension cord 16 around, every time the tool 10 or the material being worked upon has to be repositioned. Also, with GFCI, all electrical power inlet connection device applications are assured of added electrical, fire, and material security that is not currently extensively available.

While certain representative embodiments and details have been shown for purposes of illustrating the invention, it will be apparent to those skilled in the art that various changes may be made without departing from the scope of the disclosure, which is further described in the following appended claims.

What is claimed is:

1. An electrical power inlet connection device comprising:

a case;

one male electrical inlet plug fixedly attached to a continuous, planar surface of the case; and at least one female electrical receptacle fixedly attached to the continuous, planar surface of the case;

wherein the one male electrical inlet plug is in direct electrical communication with the at least one female electrical receptacle.

2. The electrical power inlet connection device of claim 1, wherein the at least one female electrical receptacle fixedly attached to the surface of the case includes a plurality of female electrical receptacles fixedly attached to the surface of the case; wherein the female electrical receptacles are in direct electrical communication with each other and in direct electrical communication with the one male electrical inlet plug.

3. The electrical power inlet connection device of claim 2, wherein each of the one male electrical inlet plug and the plurality of female electrical receptacles utilize 120 volts alternating current electrical power.

4. The electrical power inlet connection device of claim 3, wherein the case is disposed on or in a portable or a transitional physical structure.

5. The electrical power inlet connection device of claim 4, wherein the portable or transitional physical structure comprises a sawhorse, a table, a straight chair, a lounge chair, a golf cart, an automobile, a truck, a building addition, or a permanent column, a stake, a post, or a pole disposed in the ground or other structures.

6. The electrical power inlet connection device of claim 5, further comprising a ground fault circuit interrupter that is in electrical communication with the one male electrical inlet plug and the plurality of female electrical receptacles.

7. The electrical power inlet connection device of claim 6, further comprising a universal serial port that is in electrical communication with the one male electrical inlet plug, the plurality of female electrical receptacles, and the ground fault interrupter.

8. The electrical power inlet connection device of claim 7, wherein the universal serial port is connectable with electronic device batteries chargers.

9. The electrical power inlet connection device of claim 2, wherein the one male electrical inlet plug on the case is connectable with a first extension cord female receptacle and one of the female electrical receptacles is connectable with a second extension cord male plug, wherein another one male electrical inlet plug on another case is connectable with a second extension cord female receptacle so as to form an electrical daisy chain connection between the case and the another case.

10. A method of forming an electrical daisy chain connection between a first electrical power inlet connection device and a second electrical power inlet connection device, comprising:

providing the first electrical power inlet connection device including a first case having one male electrical inlet plug fixedly attached to a continuous, planar surface of the first case and a plurality of female electrical receptacles fixedly attached to the continuous, planar surface of the first case; wherein the female electrical receptacles attached to the surface of the first case are in direct electrical communication with each other and in direct electrical communication with the one male electrical inlet plug attached to the surface of the first case;

providing the second electrical power inlet connection device including a second case having one male electrical inlet plug fixedly attached to a surface of the second case and a plurality of female electrical receptacles fixedly attached to the surface of the second case; wherein the female electrical receptacles attached to the surface of the second case are in direct electrical communication with each other and are in direct electrical communication with the one male electrical inlet plug attached to the surface of the second case;

connecting a female electrical receptacle on a first extension cord with the one male electrical inlet plug on the first case;

plugging a male plug on a second extension cord into one of the female receptacles on the first case; and connecting a female electrical receptacle on the second extension cord with the one male electrical inlet plug on the second case;

thereby forming an electrical daisy chain connection between the first electrical power inlet connection device and the second electrical power inlet connection device.

11. The method of forming an electrical daisy chain connection between the first electrical power inlet connection device and the second electrical power inlet connection device of claim 10, wherein both of the electrical power inlet connection devices utilize 120 volts alternating current electrical power.

12. The method of forming an electrical daisy chain connection between the first electrical power inlet connection device and the second electrical power inlet connection device of claim 11, wherein the first and second electrical power inlet connection devices are disposed on or in a portable or a transitional physical structure.

13. The method of forming an electrical daisy chain connection between the first electrical power inlet connection device and the second electrical power inlet connection device of claim 12, wherein the portable or transitional physical structure comprises a sawhorse, a table, a straight chair, a lounge chair, a golf cart, an automobile, a truck, a building addition, or a permanent column, a stake, a post, or a pole disposed in the ground or other structures.

14. The method of forming an electrical daisy chain connection between the first electrical power inlet connection device and the second electrical power inlet connection device of claim 13, further comprising a ground fault circuit interrupter that is in electrical communication with the one male electrical inlet plug and the plurality of female electrical receptacles in each of the first electrical power inlet connection device and the second electrical power inlet connection device.

15. The method of forming an electrical daisy chain connection between the first electrical power inlet connection device and the second electrical power inlet connection device of claim 14, wherein both the first electrical power inlet connection device and a second electrical power inlet connection device further comprise a universal serial port that is in electrical communication with the one male electrical inlet plug, the plurality of female electrical receptacles, and the ground fault interrupter.

16. The method of forming an electrical daisy chain connection between the first electrical power inlet connection device and the second electrical power inlet connection device of claim 15, wherein both of the universal serial ports are capable of connecting with electronic device battery chargers.

17. A method of forming an electrical power inlet connection device, comprising:

fixedly attaching one male electrical inlet plug to a continuous, planar surface of a case;

fixedly attaching a plurality of female electrical receptacles to the continuous, planar surface of the case; wherein the female electrical receptacles are in direct electrical communication with each other and in direct electrical communication with the one male electrical inlet plug.

18. The method of forming an electrical power inlet connection device of claim 17, wherein each of the one male electrical inlet plug and the plurality of female electrical receptacles utilizes 120 volts alternating current electrical power.

19. The method of forming an electrical power inlet connection device of claim 18, wherein each of the male electrical inlet plug and the plurality of female electrical receptacles are disposed on or in a portable or a transitional physical structure.

20. The method of forming an electrical power inlet connection device of claim 19, wherein the portable or transitional physical structure comprises a sawhorse, a table, a straight chair, a lounge chair, a golf cart, an automobile, a truck, a building addition, or a permanent column, a stake, a post, or a pole disposed in the ground or other structures;

further comprising a ground fault circuit interrupter that is in electrical communication with the one male electrical inlet plug and the plurality of female electrical receptacles in each of the first electrical power inlet connection device and the second electrical power inlet connection device; and wherein each of the first electrical power inlet connection device and the second electrical power inlet connection device are capable of connecting with electronic device batteries chargers.

* * * * *